US006467321B2

(12) United States Patent
Prokopenko et al.

(10) Patent No.: US 6,467,321 B2
(45) Date of Patent: Oct. 22, 2002

(54) DEVICE FOR ULTRASONIC PEENING OF METALS

(75) Inventors: George I. Prokopenko; Oleksandr I. Kozlov, both of Kyiv (UA); Jacob I. Kleiman, Thornhill (CA); Pavel P. Micheev; Vitaly V. Knysh, both of Kyiv (UA); Yurii F. Kudryavtsev, Toronto (CA)

(73) Assignee: Integrity Testing Laboratory, Inc., Markham (CA)

( * ) Notice: Subject to any disclaimer, the term of this patent is extended or adjusted under 35 U.S.C. 154(b) by 0 days.

(21) Appl. No.: 09/867,305

(22) Filed: May 29, 2001

(65) Prior Publication Data

US 2002/0014100 A1 Feb. 7, 2002

(30) Foreign Application Priority Data

May 30, 2000 (UA) ..... 2000053096

(51) Int. Cl.[7] ..... B21D 41/00; B21C 43/00

(52) U.S. Cl. ..... 72/53; 72/430; 29/81.14; 173/133

(58) Field of Search ..... 72/53, 430; 29/81.14; 173/31, 133

(56) References Cited

U.S. PATENT DOCUMENTS

| | | | | | |
|---|---|---|---|---|---|
| 2,356,314 | A | * | 8/1944 | Gray et al. | 28/81.14 |
| 3,150,888 | A | * | 9/1964 | Parker | 29/81.14 |
| 3,349,461 | A | * | 10/1967 | Niedzwiecki | 29/81.14 |
| 3,359,611 | A | * | 12/1967 | Kelley | 29/81.14 |
| 3,451,490 | A | * | 6/1969 | Troike | 173/31 |
| 3,595,325 | A | | 7/1971 | Libby et al. | 173/117 |
| 3,609,851 | A | | 10/1971 | McMaster et al. | 29/243.54 |
| 3,680,643 | A | * | 8/1972 | Cameron et al. | 173/133 |
| 3,937,055 | A | * | 2/1976 | Caurso et al. | 72/399 |
| 6,171,415 | B1 | | 1/2001 | Statnikov | 148/525 |

FOREIGN PATENT DOCUMENTS

| | | | | |
|---|---|---|---|---|
| SU | 290394 | * | 8/1953 | 72/53 |
| SU | 472782 | | 6/1976 | |
| SU | 1235932 | * | 6/1986 | 72/53 |
| UA | 13936 | | 10/1995 | |

OTHER PUBLICATIONS

Feng, et al. "Impact of a Spherical Tool Against a Sonic Transmission Line", Journal of Acoustical Society of America, V. 52, No. 1 Pt 2 1972 pp 254–259.

Trufiakov, et al. "Ultrasonic Impact Treatment of Welded Joints", IIW Doc XIII–1609–95, Kiev, Ukraine, Severodvinsk, Russia 1995.

Statnikov, et al. "Specification for Weld Toe Improvement by Ultrasonic Impact Treatment", IIW Doc XIII–1617–96, Int. Inst. of Welding, Severodvinsk, Russia 1996.

* cited by examiner

*Primary Examiner*—David Jones
(74) *Attorney, Agent, or Firm*—Fay, Sharpe, Fagan, Minnich & McKee, LLP

(57) ABSTRACT

A device for ultrasonic peening of metals is intended for strengthening and relaxation treatment of metal surfaces with an ultrasonic oscillation and includes an ultrasonic generator (1) having the optimized power of from 0.2 to 0.5 kW, a piezoelectric transducer with an ultrasonic velocity transformer (6) and a set of readily replaceable heads with striking tools (pins). Various sizes and arrangements of the tools allow for ultrasonic peening of parts of complicated configuration fast and efficiently. In the device, drop-wise cooling and lubrication of striking tools, as well as of treatment area are provided.

17 Claims, 5 Drawing Sheets

DEVICE FOR ULTRASONIC PEENING OF METALS

FIELD OF THE INVENTION

The present invention relates generally to the field of metal peening, and more particularly, to methods and devices for ultrasonic peening of metals for general strengthening and stress relaxation of metals.

BACKGROUND OF THE INVENTION

Ultrasonic peening of metals has been known for many years. For example, SU Patent 472,782 discloses a device for treatment of metals with an ultrasonic oscillation using a magnetostrictive transducer. The device comprises a transducer, an ultrasonic velocity transformer and a holder in the form of guide skirt with holes in its bottom connected in series. Tools in the form of stepped rods are located in the holes. The holder is attached to a flange located in a nodal plane of the ultrasonic velocity transformer, and the rods are axially displaceable in a direction perpendicular to a surface to be treated. The main disadvantages of this device are:

- the holder is fixedly fastened in the nodal plane of the ultrasonic velocity transformer resulting in non-uniform treatment of metal surfaces by multiple-striker heads;
- the rod tools usually function under heavy conditions of high-frequency impact loading, are subject to wear and fatigue destruction, and their replacement is time consuming causing reduced efficiency of treatment;
- the use of magnetostrictive transducers for ultrasonic peening also has its disadvantages, since the transducers of this kind often require pumped cooling water systems which makes such devices more complicated, heavier and increases the cost of the equipment; and
- the stepped rods or pins have thickenings at their upper ends to keep them in the working head during treatment which significantly complicates the process of their manufacture and reduces their service life.

The above mentioned disadvantages are to some extent reduced in an ultrasonic device for strengthening of metal surfaces disclosed in Ukrainian Patent No. 13,936 dated January 1997. This teaches a device which has connected in series, a transducer, an ultrasonic velocity transformer and a holder in the form of guide skirt with holes in its bottom. Pins with conical thickenings are located in the holes, and the holder is mounted for free rotation. The holder is retained on the body of the device by a cylindrical ring spring which fits in an appropriate groove of the ultrasonic velocity transformer. A plate made of a high-strength material is located between the pins and the end of the ultrasonic velocity transformer. The disadvantages of this ultrasonic device are:

- when operating for a period exceeding 3–5 minutes the tool and the holder are, as a result of impact energy absorption, heated up to the temperature more than 100° C., and after this it is necessary to interrupt treatment to cool the head; and
- the working head has striking tools arranged in a honeycomb pattern, which is intended mainly for strengthening of flat surfaces. This pattern of tools is of little use in treating welds having various geometric configurations.

In both of these prior art devices there is a need, because of the inefficiencies of design which result in waste heat being produced for forced cooling. The forced cooling takes the form of stopping the treatment, for example to dunk the working head in water or in oil until it cools down.

SUMMARY OF THE INVENTION

It is therefore an object of the present invention to provide a new and improved device for ultrasonic peening of metals, which is easy to use, lightweight, efficient and effective.

It is a further object of the present invention to provide a tool that, on the one hand has an enough power to achieve good peening results and yet on the other hand is small, light weight and can easily be applied by a person to a metal which could benefit from the treatment.

It is a further object of the present invention to provide a new and improved device for ultrasonic peening of metals in which, the ultrasonic generator and piezoelectric transducer operate over a range of powers to optimize the efficient conversion of electric power into ultrasonic power, while simultaneously decreasing the weight of the ultrasonic generator and the transducer, eliminating the necessity of forced cooling of transducer thereof and thus reducing the total cost and weight of the ultrasonic peening equipment.

It is a still further object of the present invention to provide an efficient device for ultrasonic peening of metals that allows for continual passive cooling of the working head, where the amount of cooling increases with increased need of cooling to permit uninterrupted treatment of a workpiece. It is a further object to configure the operative components to provide such continued passive cooling.

It is another object of the present invention to provide a new and improved device for ultrasonic peening of metals which provides multiple replaceable tool heads having a selection of tool configurations such as single-striker, single-row and multiple-striker heads with various diameter of strikers suited to various sizes and types of welds and metal shapes to be treated. It is a further object to configure the operative components of the working head to increase the efficiency of treatment and to increase the service life of device.

Accordingly, the present invention provides a device for ultrasonic peening of metals comprising, connected in series, an power-optimized (most preferably in 0.2 to 0.5 kW range) ultrasonic generator and piezoelectric transducer, an ultrasonic velocity transformer, a holder in the form of a skirt mounted for free rotation around the axis of the ultrasonic velocity transformer, the skirt having holes in its bottom in which pins are located, a plate of a high-strength material located between the pins and the end of the ultrasonic velocity transformer which is fixed to the free end of the transformer for increasing the efficiency of the energy transfer, a casing arranged in a node of an oscillation and filled with a porous material impregnated with a lubricant-coolant, the porous material being foamed polyurethane and said lubricant-coolant being an oil-in-water emulsion with added surfactants, a cylindrical projection located in the lower part of the casing at the middle part of the thin end of the ultrasonic velocity transformer, and a set of replaceable heads adapted for various number, sizes and arrangement of the tools.

BRIEF DESCRIPTION OF THE DRAWINGS

Other objects, features and advantages of the present invention will become apparent upon reading the following detailed description of a preferred embodiment thereof provided by way of example only, and with reference to the accompanying drawings in which.

DETAILED DESCRIPTION OF THE PREFERRED EMBODIMENTS

Figure 1:
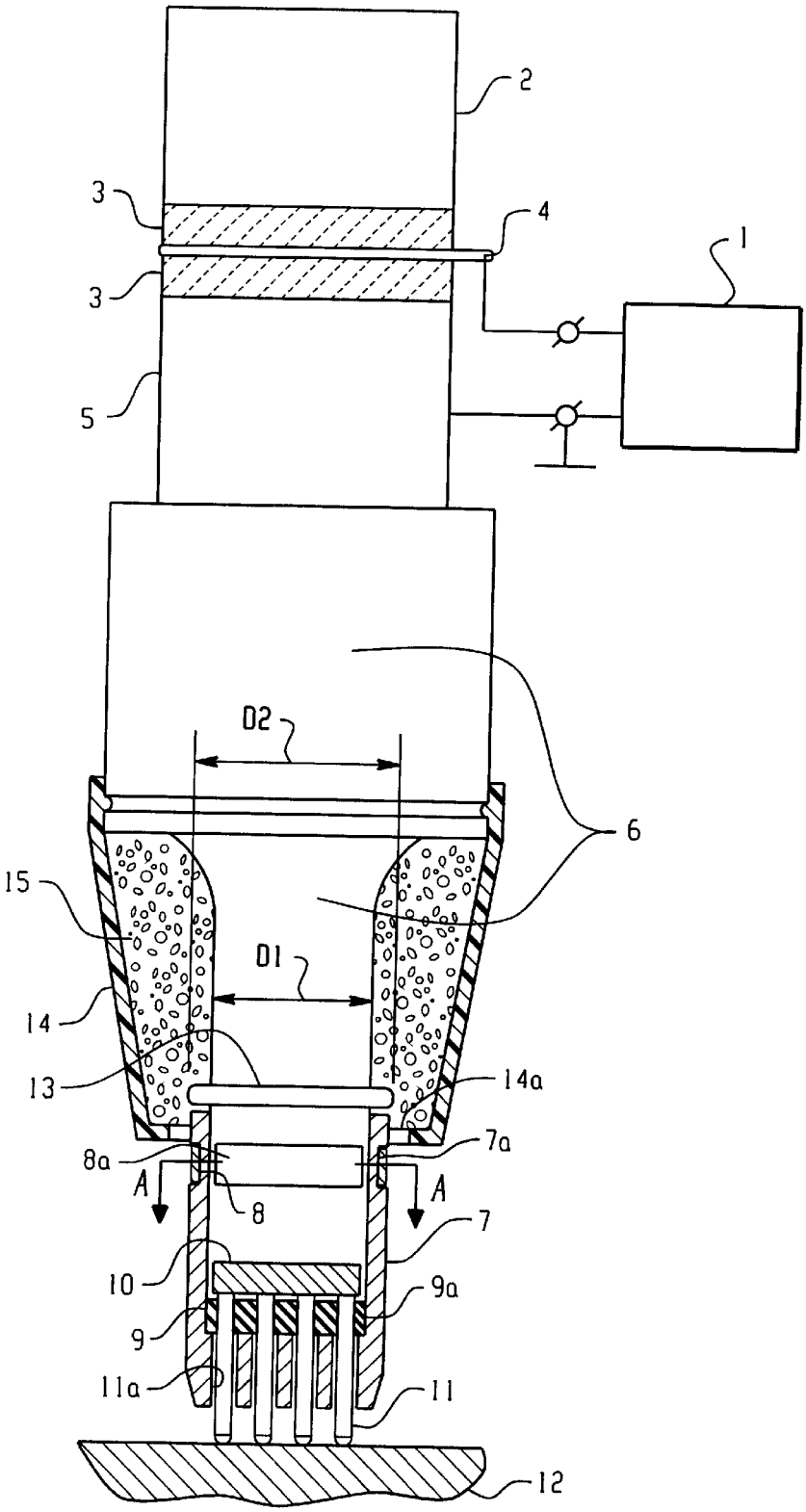
FIG. 1 is an elevation schematic view of a device for ultrasonic peening of metals according to the present invention and a cross sectional schematic view of an ultrasonic velocity transformer thereof respectively.
Figure 1A:
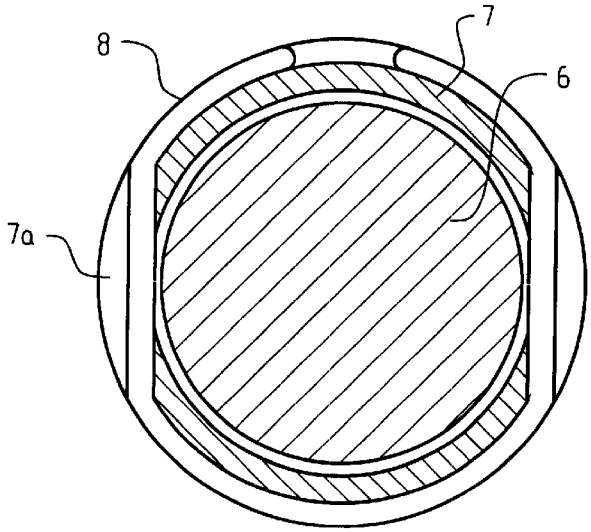
FIG. 1A is a cross-sectional view taken along lines A—A of FIG. 1.

Referring to FIG. 1, a device for ultrasonic peening of metals includes an ultrasonic generator 1, operatively connected to a piezoelectric transducer. The transducer consists of a rear strap 2, piezoelectric ceramic plates 3 between which an electrode 4 is arranged and a front strap 5. The piezoelectric transducer functions to convert the electrical signal to mechanical movement. An ultrasonic velocity transformer 6 is operatively attached to the transducer. The ultrasonic velocity transformer 6 has an impact head located at its thin end and comprises a holder 7 with a slot 7*a* for a flat shaped spring 8 that partially fits in a respective ring groove 8*a* in the ultrasonic velocity transformer 6. An elastomeric retaining element 9 is also provided. A plate 10 made of a high-strength material is located under the end of the ultrasonic velocity transformer 6 and is joined to the free end of the transformer 6 by, for example, a threaded connection (shown in FIG. 3A as 10*a*). Rod tools, or pins 11 are held in the elastomeric element 9 in holes 9*a*. These holes 9*a* in elastomeric element 9 have a slightly smaller diameter than the diameter of the pins 11, sufficient to hold in the pins 11 during ultrasonic peening. These pins 11 extend through corresponding holes 11*a* made in the bottom of the holder 7. The lower rounded ends of the pins 11 can be brought into contact with a work-piece 12. The ultrasonic velocity transformer 6 has a diameter D1, and has a cylindrical projection 13 having diameter 1.2 D1. The projection 13 functions to help passive cooling as explained in more detail below. The plastic casing 14 is attached to the ultrasonic velocity transformer 6, most preferably at a nodal point of oscillation. The casing 14 is filled with a porous material 15 saturated with a suitable lubricant-coolant. The cross-section along the line A—A of FIG. 1A illustrates the shape of the flat spring 8 holding the head on the end of the ultrasonic velocity transformer 6.

Working Head

The impact or working head (which consists of the holder 7, the pins 11 and elastomeric retaining element 9) is most preferably easily removable. This permits the easy replacement of a head with another head of different diameter of pins and disposed in different combinations: single-row, single-peen, multiple-pins etc. (FIG. 2–4). The head is held on the end of transformer with the help of the spring 8 with the width of approximately 5 mm, The spring fits in the groove 8*a* and two slots 7*a* in the holder 7, in which the spring 8 is placed. On the end of the transformer 6, the groove 8*a* has a depth of 0.5 mm and width about 6 mm. As a result, the spring 8, and consequently also the head are reliably held on the end of the transformer. The head also freely rotates around its longitudinal axis. For this purpose the internal diameter of the holder 7 is larger by 0.2 mm than D1. This also permits the head to freely slide off the end of the transformer 6 when the spring 8 is removed.

In the base of the replaceable head holes 11*a* are bored in accordance with the quantity and sizes of pins 11 desired. The pins 11 also freely slip within these holes 11*a*. The diameter of these holes 11*a* is larger than the diameter of pins 11 by 0.1–0.2 mm. Between the pins 11 and the ultrasonic velocity transformer end is the plate 10, made from a high-strength material. Plate 10 protects the working end of transformer (which is made, for example, from aluminium or titanium alloy) from deformation during a long period of operation, Further, the plate 10 more efficiently transfers energy into the pins, reducing the amount of waste heat produced. The elastomeric retaining ring 9 prevents the pins 11 from falling out of the holder 7 during the use of the device. The pins are located in the holes 9*a* in the ring 9. These holes 9*a* in ring 9 have a slightly smaller diameter than a diameter of pins 11, preventing the pins from falling out during ultrasonic peening.

As can be seen from the design, the holder 7 is not exposed to considerable dynamic loads during the operation of the device. Therefore it is preferably made from low strength materials such as brass or steel with an antirust coat. The pins 11 must have high hardness and shock-toughness. They are preferably made from ball bearing steel. For example, cylindrical rollers from bearings (diameter 2.5 up to 5 mm) can be used for this purpose. The elastomeric retaining ring 9 eliminates the need for thickenings on one end of a pin 11 made, for example, by argon-arc welding as required by the prior art.

Figure 2A:
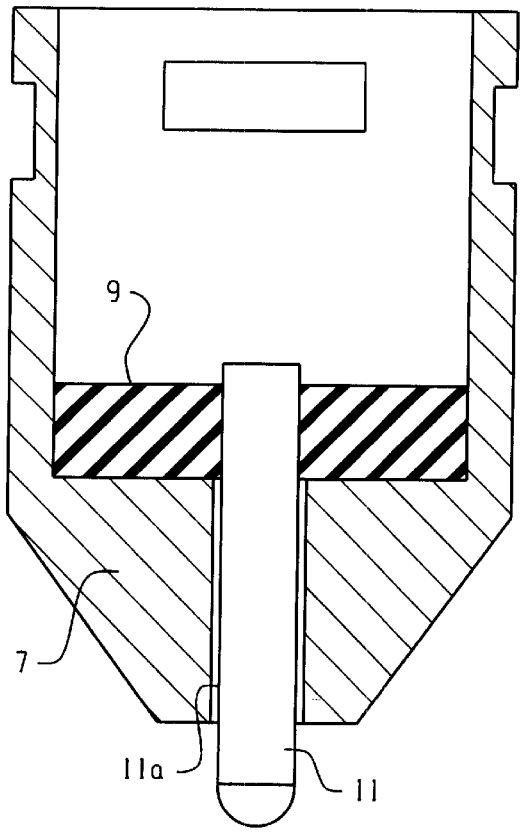
FIG. 2A is an elevation schematic view of a form of replaceable head.
Figure 2B:
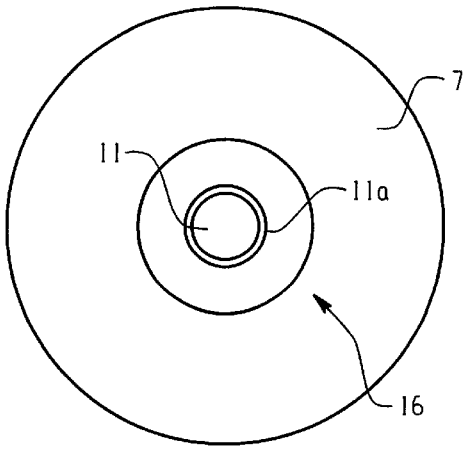
FIG. 2B is a cross-sectional schematic of the replaceable head of FIG. 2A.

FIGS. 2A and 2B show a single-pin head 16 that is generally applied for treatment of difficult-to-access surfaces such as holes, crossing welds etc.

Figure 3A:
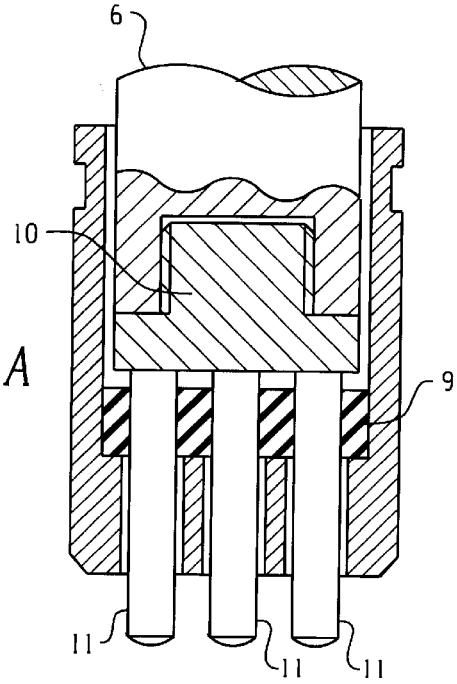
FIG. 3A is an elevation schematic view of one form of replaceable head.
Figure 3B:
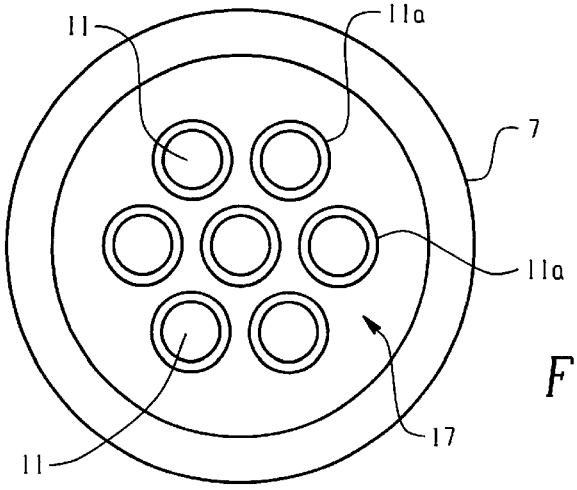
FIG. 3B is a cross-sectional schematic of the replaceable head of FIG. 3A.

FIGS. 3A and 3B shows a multiple-peen head 17, which is mainly applied for treatment of planar surfaces or surfaces with a large radius of a curve ($R^3$ 100 mm).

Figure 4A:
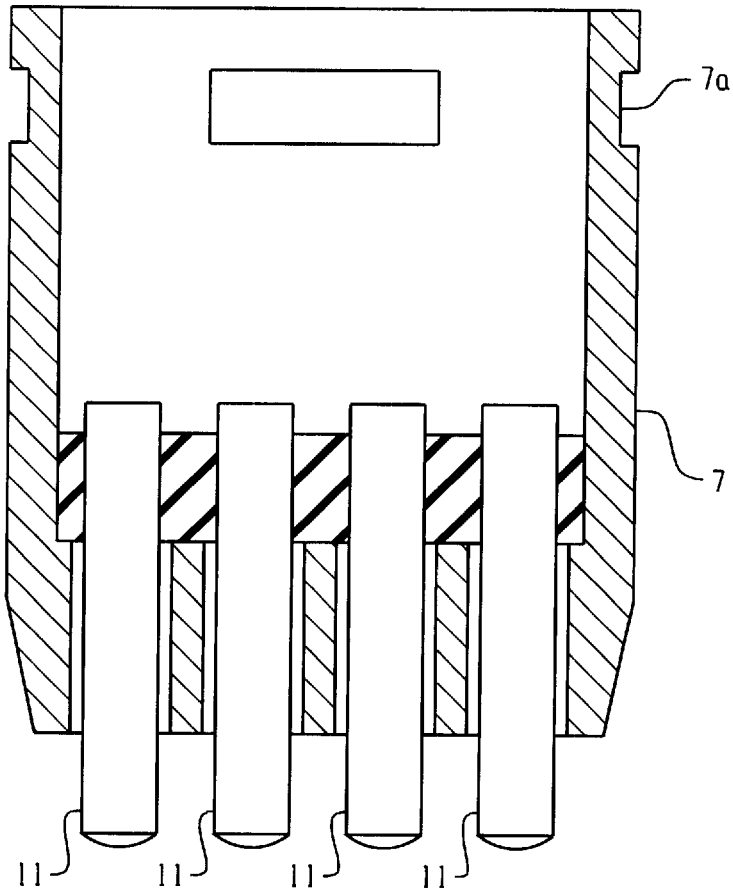
FIG. 4A is an elevation schematic view of one form of replaceable head.
Figure 4B:
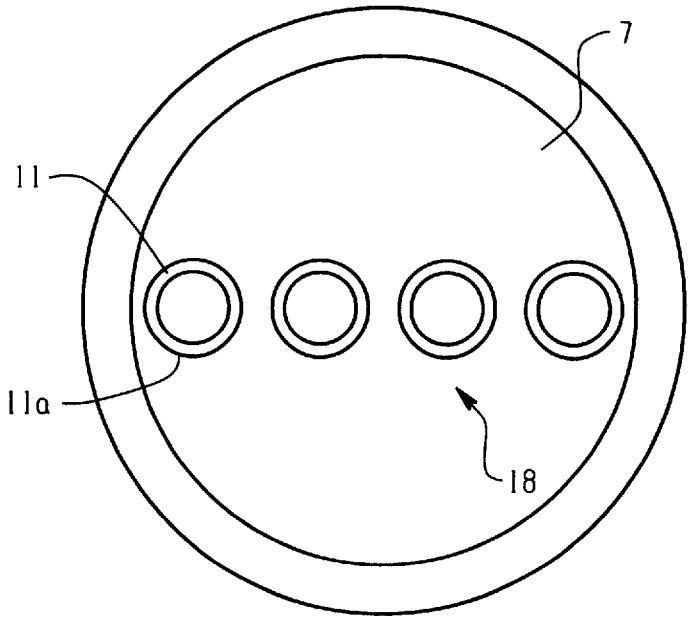
FIG. 4B is a cross-sectional schematic of the replaceable head of FIG. 4A.

FIG. 3A shows also how the plate 10 is fixed on the end of the transformer 6 with the help of a threaded connection 10*a*. Most preferably, the plate 10 is made from a high wear high strength steel;

FIGS. 4A and 4B show a single-row head 18 that is applied, for example, for treatment of weld toe zones.

Optimized Power

The main problem in the design and manufacturing of ultrasonic equipment for ultrasonic peening is to provide the optimal peening function with minimum cost, labour and power consumed. Both magnetostrictive and piezoelectric transducers of different power can be used for ultrasonic peening. The magnetostrictive transducers work steadily practically with any kinds of acoustic loads, since they have a wide resonance curve. That facilitates the set-up of a vibration system in a resonance mode. The generators and transducers with power consumption 1.0–1.5 kW are usually applied for this purpose. However, a coefficient of efficiency of such equipment is low (0.4–0.5). The equipment in this case has a considerable weight (25–60 kg) and it requires the water-cooling system for the transducer, These circumstances limit the portability of such ultrasonic equipment for ultrasonic peening on the basis of magnetostrictive transducers.

The piezoelectric transducers have more acute resonance curve, therefore are more sensitive to load. However, they can be designed to operate at specific optimum frequencies, allowing such transducers to work steadily in different conditions, including with an impact load. At the same time the application of piezoelectric transducers have a relatively high coefficient of efficiency (up to 0.7–0.8), which permits a lower total weight of the equipment (i.e. less power is required). Since more energy is going into peening, less heat is generated lowering the need for forced water-cooling of the transducer. These factors reduce the cost of the equipment and enable small-sized portable ultrasonic peening devices, which can be manually applied to welds of large parts and structures such as bridges, ships, offshore platforms, hoisting cranes etc. in field conditions.

The power of ultrasonic generators—250–500 W is selected due to following reasons. Transducers of these powers (piezoelectric and magnetostrictive), will support a given oscillation amplitude at the end of the ultrasonic velocity transformer (25–40 $\mu$m) at a combined load (static 20–50 N, impact 200–300 N) during treatment. At such powers it is preferred to use uncooled piezoelectric transducers having higher coefficient of efficiency=P2/P1, where P1—power consumed from a circuit, P2—power, discharged in load, as contrasted to magnetostrictive transducers (0.8 and 0.5 respectively).

An important advantage of a piezoelectric transducer is eliminating the need for water-cooling of the transducer. A biasing magnetisation current of the transducer is also not required, These factors, in combination with the factor that at the high operating frequency the current at the resonance mode does not exceed 0.5 A, allow considerably lower weight and overall dimensions for ultrasonic generators according to the present invention. This permits light portable equipment for manually applied ultrasonic peening, Also, a smaller sized device can be used to reach hard to access places.

There are two ways to transmit ultrasonic vibrations in to the element being treated. In first case the tool (which may be a hardened sphere or rod) is rigidly connected to an end of ultrasonic velocity transformer. The acoustic contact with a surface is provided by pressing the rigidly connected vibration system, freely sliding in direction of treatment, with force F1≈100–200 N. In this case a waveguide end and a pin oscillate together as a unit with ultrasonic frequency. If the surface of a treated element is rigid enough, then at counter impacts there is a recoil of the whole vibration system to some height and the transducer continues to vibrate even though not in contact with the work piece. Therefore to maintain efficiency of treatment it is necessary to increase the force of pressing. This results in a necessity of increasing ultrasonic peening transducer power. In other words increasing the load on the transducer end demands a corresponding increase of transducer power.

In this respect tools (hardened sphere or rod) which are not rigidly connected to the ultrasonic velocity transformer are more energy efficient, since weight of each tool is small and it doesn't have an effect on operational mode of the transducer. The pressing of the transducer with small force during treatment results in the formation of some gap in which the ball or the rod is vibrating. The design with intermediate element has shown higher efficiency of treatment as compared with a rigid fastening of a tool. It deals mainly with the counter impacts of pin to the ultrasonic velocity transformer end leading to an increase in speed and striking force. The frequency of impacts in this case is lower, but is still high enough for an effective surface treatment.

Low weight pins permit a lowering of the power of the ultrasonic generators and transducers. In this case load on the transducer is considerably reduced, which enables it to oscillate with given amplitude. The values of amplitude during ultrasonic peening are usually 25–40 $\mu$m. If the power of the transducer is small, even small end loads can result in a fall off of amplitude. It has now been discovered that there is a particular optimum power range for the ultrasonic equipment, in which vibration amplitude even under load is still maintained at the required level. The lowering of power will cause a suppression of vibration amplitude, but increasing power does not increase the vibration amplitude in any useful way, resulting in unnecessary power, with attendant increases of weight, consumed power and cost of the equipment.

Figure 5:
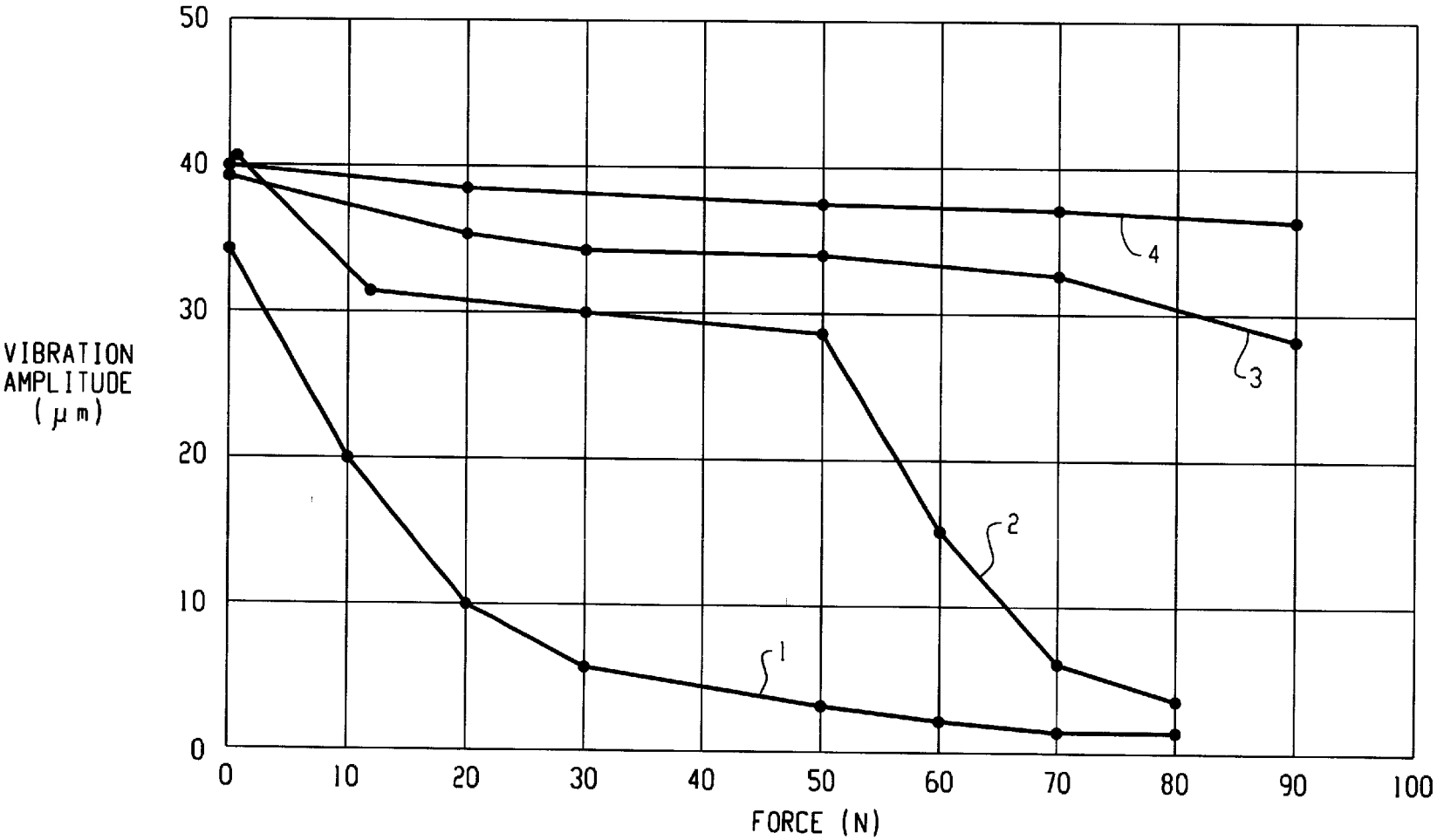
FIG. 5 shows how the vibration amplitude varies according to the load applied through the intermediate elements at various powers.

It has now been determined that the optimum power range for ultrasonic peening is 250–500 W. Behaviour of ultrasonic transducers of different power under load was studied and vibration amplitudes were measured as shown in FIG. 5. This FIG. shows 1—generator USDN-A (100 W), 2—generator USG-250 (250 W), 3—generator MW 600 LC (500 W), 4—generator USG-1—1 with magnetostrictive transducer (1000 W). The standard ultrasonic generators and transducers (piezoceramic and magnetostrictive) of different power and also new designed equipment were used for studies. The power of these installations was 100, 250, 500 and 1000 W. The dependence of vibration amplitude of the ultrasonic velocity transformer end on the force of pressing of the transducer was investigated. It was found, that vibration amplitude of transducer (power 100 W) is sharply reduced with the increase of the force of pressing (curve 1). At power level 250 W the initial lowering of amplitude of approximately 10 $\mu$m is observed and then up to 50 N the amplitude does not practically change and drops with further increase of load (curve 2). Usage of the equipment with power of 500 W displays that vibration amplitude decreases approximately by 10 $\mu$m in all range of the investigated loads (curve 3). Amplitude of the magnetostrictive transducer with the power of 1000 W (curve 4) is changing even less than in previous cases. It is known that the load during ultrasonic peening is usually in the range of 20–50 N and the vibration amplitude should be 25–40 $\mu$m to achieve effective peening. Thus, the optimum power of the ultrasonic equipment for ultrasonic peening is within the range 250–500 W. In this range of power it is expedient to use piezoelectric transducers and special generators with stabilisation of frequency and vibration amplitude. This provides smaller overall dimensions, weight and cost of the equipment for ultrasonic peening. Optimum sample of such equipment (power 300 W) was designed, manufactured and successfully tested.

The comparison of the efficiency of ultrasonic peening of welded specimens by transducers with 250 W (piezoelectric) and 1000 W (magnetostrictive) were carried out. Samples from steel ($s_y$=1000 MPa) with thickness 30 mm, length 450 mm and width 150 mm in the form of T-shaped welded joint were treated in the zone of weld toe during 2 minutes by different tools. The fatigue tests with the asymmetric bending and frequency of loading 12 Hz were carried out on the fatigue machine UMD-100. The tests have shown, that in an initial condition after welding the fatigue life at the level of alternating stresses s=500 MPa was 103000 cycles. After treatment of 5 specimens by tool with power of 250 W the fatigue life was in average 750,000 cycles, and with the power of 1000 W–800,000 cycles. As can be seen, the power reduction of equipment by 4 times has resulted in practically the same efficiency of ultrasonic peening. It confirmed the statement that there is an optimum power range of the ultrasonic equipment for ultrasonic peening.

Cooling of the Impact Head and Treatment Zone

The passive cooling is provided by a cooling means which includes, in said plastic casing 14 a compliant porous material, for example, an open pore sponge or foam rubber that is capable of storing a cooling liquid up to for example, about 90% by weight. The preferred material should be inert in relation to water, alcohol and engine oil, and also to other standard lubricate-cooling liquids (LCL). The porous material is placed in the cavity (which can be of any shape) surrounding thin end of the transducer. The conical shape for the plastic casing 14 shown is preferred for the convenience of the operator to be able to see the treatment zone. Through an opening 14*a* in the cavity the cooling liquid can be injected into the porous material by syringe if more is needed during use of the device. If the thin end of the transformer is smooth the supply of the liquid will not be good enough. To improve the passive cooling liquid supply the cylindrical projection 13 is provided, which impinges on the material. The ultrasonic vibrations in this case will spread better into the cooling liquid, initiating a drip flow through opening 14*a* or sputtering and refluxing on the working head and treatment zone because of capillary effect.

For efficient cooling it is necessary to select liquid with maximum heat conductivity, which is fire safe, not toxic and does not cause an active corrosion of treated surfaces. The most widespread cooling liquid is water having high heat conductivity at 50° C. with c=0.648 W/(m·degree). Spirit's and engine oil have the factor c equals to 0.177 and 0.122 W/(m·degree), respectively. Also, any standard LCL used for treatment of metals by cutting can be used. As a rule, it is a water pap of different oils with the components of surface-active substances (SAS).

The device for ultrasonic peening of metals according to the present invention is operated as follows.

Before the beginning of the process of treatment, the lower end of the device is put into contact with the surface of the work-piece 12, and the entire oscillatory system, including the transducer, the ultrasonic velocity transformer 6 and the head, is pressed to the work-piece with a force ranging from 40 to 50 N. Then, the voltage applied from the ultrasonic generator 1 to the transducer excites therein a longitudinal ultrasonic oscillation with the frequency of about 20 kHz. The ultrasonic velocity transformer 6 reinforces the amplitude of oscillation on its free end up to about from 25 to 40 $\mu$m. Because of impact action of the end of the ultrasonic velocity transformer 6 oscillation is transmitted to the pins 11 which deform in impact mode the surface of the work-piece 12. The acceleration of the liquid travel through capillaries of the porous material 15 under the influence of the ultrasonic waves causes the ultrasonic oscillation of the cylindrical projection 13 to enhance the inflow of the lubricant-coolant to the gap between the output end of the acoustic velocity transformer 6 and the holder 7. As the lubricant-coolant is consumed, more is added through openings in the casing 14. For ultrasonic peening of parts of different configuration the different types of heads are used: a single-striker head 16, a multiple-striker head 17 and a single-row head 18. Mounting and dismounting of the heads is carried out by spreading the ends of the flat spring 8 that fits in the groove at the end of the ultrasonic velocity transformer 6. It has been found that an uncooled piezoelectric transducer at this power can operate a working head, cooled by passive cooling, in an uninterrupted manner.

The device for ultrasonic peening of metals according to the present invention can be manufactured by industrial methods and may be used in portable peening treatment for many applications such as in machine manufacturing, bridge building, ship building and other industries involving the manufacture of parts and welded elements to be operated under dynamic and vibration loading.

While the present invention has been illustrated and described in accordance with a preferred embodiment, it will be understood that many variations, modifications and improvements may by made herewith without departing from the spirit and scope of the invention as set forth in the following claims.

We claim:

1. A device for the ultrasonic peening of metals comprising:

an ultrasonic generator;

an uncooled piezoelectric transducer operatively connected to said ultrasonic generator;

an ultrasonic transformer operatively connected to said piezoelectric transducer;

a working head releasably connected to said ultrasonic transformer, said working head including a holder having one or more freely moving pins extending therefrom for working a work-piece, said pins being sized and shaped to be vibrated by said transducer;

wherein said ultrasonic generator has sufficient power to cause said pins to vibrate at amplitudes of about between 25 to 40 $\mu$m under axial loading of about 25 to 50 N for uninterrupted working of a work piece.

2. A device as claimed in claim 1 wherein said ultrasonic generator is sized to deliver between 250 to 500 watts of power.

3. A device as claimed in claim 1 further including a cooling system, operatively connected to the working head wherein said cooling system provides passive cooling of the working head.

4. A device as claimed in claim 3 wherein said cooling system comprises a casing containing a cooling liquid, said casing being mounted to said device at a nodal point of oscillation of said ultrasonic transformer.

5. A device as claimed in claim 4 wherein said casing is generally conical to permit a user to be able to see said at least one pin contacting said work-piece.

6. A device as claimed in claim 4 wherein said cooling system includes an open celled resilient foam, and said cooling liquid is carried by said open celled resilient foam.

7. A device as claimed in claim 6 wherein said ultrasonic transformer is sized and shaped to impinge on said foam to cause said cooling liquid to drop from said cooling system to gradually cool said working head and said work piece.

8. A device as claimed in claim 4 wherein said cooling liquid is generally inflammable, has a high heat conductivity, is nontoxic and is non-corrosive.

9. A device as claimed in claim 7 wherein the more said ultrasonic transformer vibrates, the more impingement occurs on said foam thereby causing more cooling liquid to contact said holder and said pins.

10. A device as claimed in claim 1 wherein said ultrasonic transformer includes a high strength high wear plate fixed thereto for transferring vibration to said pins.

11. A device as claimed in claim 10 wherein said high strength high wear plate is fixed to said ultrasonic transformer by a threaded connection, wherein said wear plate is replaceable.

12. A device as claimed in claim 1 wherein said working head further includes an elastomeric retaining element for retaining said pins in said head.

13. A device as claimed in claim 12 wherein said pins are generally cylindrical and are resiliently held in said elastomeric retaining element.

14. A device as claimed in claim 12 wherein said elastomeric retaining element is sized and shaped to permit said pins to vibrate without coming free of said elastomeric retaining element when said device is in use, but also to permit said pins to be removed and replaced when worn.

15. A device as claimed in claim 1 wherein said working head is retained on said device by a removable spring.

16. A device as claimed in claim 15 wherein said removable spring is a flat spring fitting into a slot on said head and a groove on said ultrasonic transformer.

17. A device as claimed in claim 1 including a plurality of individually mountable replacement heads, each having various pin sizes and patterns suitable for working work pieces of various configurations.

* * * * *